United States Patent [19]

Watarai et al.

[11] 4,109,175

[45] Aug. 22, 1978

[54] HIGH PRESSURE SODIUM VAPOR DISCHARGE LAMP

[75] Inventors: Yoshiaki Watarai, Takatsuki; Haruo Yamazaki, Moriyama; Naoki Saito; Masayuki Yamaguchi, both of Takatsuki; Takio Okamoto, Kusatsu; Hidezo Akutsu, Kobe, all of Japan

[73] Assignee: Matsushita Electronics Corporation, Kadoma, Japan

[21] Appl. No.: 777,149

[22] Filed: Mar. 14, 1977

[30] Foreign Application Priority Data

| | | | |
|---|---|---|---|
| Mar. 19, 1976 | [JP] | Japan | 51-30190 |
| Sep. 20, 1976 | [JP] | Japan | 51-113429 |
| Sep. 20, 1976 | [JP] | Japan | 51-113432 |

[51] Int. Cl.[2] ..... H01J 61/18

[52] U.S. Cl. ..... 313/112; 313/113; 313/229; 313/489

[58] Field of Search ..... 313/112, 229, 489, 113

[56] References Cited

U.S. PATENT DOCUMENTS 3,898,504 8/1975 Akutsu et al. ..... 313/220

*Primary Examiner*—Rudolph V. Rolinec
*Assistant Examiner*—Darwin R. Hostetter
*Attorney, Agent, or Firm*—Cushman, Darby & Cushman

[57] ABSTRACT

A high pressure sodium vapor discharge lamp comprises an alumina tube envelope containing therein sodium, inert starting gas, buffer gas source of mercury or cadmium and discharge electrodes sealed in the envelope, inner diameter $d$ (in mm) of said tube envelope and an average potential gradient E in volt/cm having the relation $$E \geqq 37.7 - 2.05d,$$

and further comprises a radiation suppressing means for selectively absorbing red radiation of a wavelength longer than 620 nm said radiation suppression means being disposed on the wall of outer bulb enclosing the tube envelope;

the lamp achieves higher color temperature and higher general color rendering index than the conventional one without increasing its tube voltage and is suitable for highly efficient indoor illumination.

11 Claims, 9 Drawing Figures

Solid lines: for dischage tube of 2500°K
dotted lines: for dischage tube of 2800°K

HIGH PRESSURE SODIUM VAPOR DISCHARGE LAMP

BACKGROUND OF THE INVENTION

The present invention relates generally to a high pressure sodium vapor discharge lamp using an alumina tube which is translucent or transparent and in which sodium for producing radiation, buffer gas and inert starting gas are contained.

As described in column 3, lines 58–65 of U.S. Pat. No. 3,898,504, by some of the inventors of the present invention, the following high pressure sodium vapor discharge lamp has good color rendition with color acceptability of over 1.0 in operation:

a high pressure sodium vapor discharge lamp comprising a translucent tube envelope containing therein sodium, inert starting gas, buffer gas comprising at least one of mercury and cadmium and discharging electrodes sealed in the envelope, diameter $d$ in mm of said lamp tube and an average potential gradient E in volts/cm having the relation of:

$$E \geqq 37.7 - 2.05d.$$

However, it is difficult to realize a practical high pressure sodium vapor discharge lamp having color temperature of over 2500° K. Though it is theoretically possible to raise the color temperature to 2500° K to 3500° K simply by raising sodium vapor pressure in the discharge tube, such increase in the vapor pressure results in disadvantages of lowering efficiency and excessively high lamp voltage, thereby deleteriously affecting utility. The general color rendering index, the color temperature and the color acceptability of the lamp are defined and elucidated in C.I.E. (Commission Internationate de l'Eclairage) recommendation.

SUMMARY OF THE INVENTION

The principal object of the present invention is to propose an improved high pressure sodium vapor discharge lamp capable of performing a high color temperature as well as satisfactory color rendition and efficiency.

Another object of the present invention is to propose an improved high pressure sodium vapor discharge lamp capable of achieving a high color temperature without adverse increases of lamp voltage of bulb wall loading, hence dispensing with expensive ballast.

A lamp in accordance with the present invention can achieve such satisfactory performance as color temperature of more than 3000° K, general color rendering index of 60 to 90 and satisfactory efficiency for a high pressure sodium lamp for operation with economical ballast.

DESCRIPTION OF PREFERRED EMBODIMENTS

Figure 1:
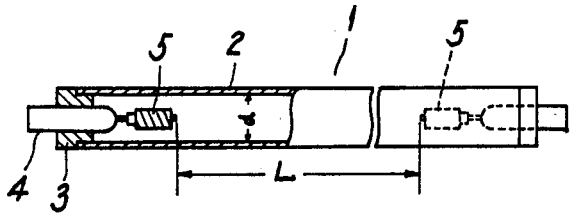
FIG. 1 is a partial sectional side view of a discharge tube illustrating an exemplary lamp structure embodying the present invention.

The present invention is described hereinafter referring to the drawing which shows preferred embodiments of the present invention.

The high pressure sodium vapor discharge lamp of a preferred example comprises a discharge tube 1 shown in FIG. 1, wherein the tube envelope 2 is made of translucent polycrystalline alumina having a pair of electrodes 5 supported by lead-in metal tubes 4 and 4 made of niobium. The niobium tubes 4 and 4 penetrate and are supported by the end discs 3 and 3 which are made of ceramic and seal both ends of the tube envelope 2. The tube envelope 2 contains sodium as a metal for producing radiation, mercury or cadmium as a buffer gas and xenon as a starting inert gas. The tube envelope 2 has an inner diameter $d$ in the range of 6.3mm to 13.5mm. The inter-electrode gap L is in the range of 25mm to 82mm. The amount of the sodium is in the range of 3 mg to 15 mg, and the amount of the mercury is in the range of 3 mg to 60 mg for each tube envelope. The volume of xenon as the starting inert gas is sufficient to exert a pressure of about 20 Torr at room temperature.

Some modification can be made by using the following equivalent substances in place of the abovementioned parts and elements: The tube envelope 2 can be made of single-crystalline alumina. The metal as the source of the buffer gas can be 10 mg to 80 mg of cadmium. The starting inert gas can be about 20 Torr in room temperature of neon-argon penning gas (Ne added by 0.1 to 1.0% of Ar).

Figure 2:
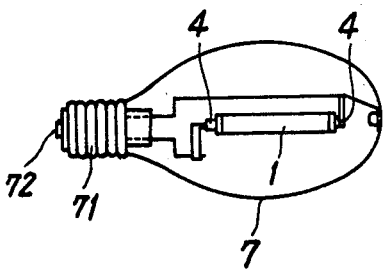
FIG. 2 is a side view of a high pressure sodium vapor discharge lamp which includes the discharge tube of FIG. 1.

The discharge tube 1 is sealed in an outer bulb 7 as shown in FIG. 2, wherein both lead-in metal tubes 4 and 4 are connected to known base metals 71 and 72. In general the inside space of the outer bulb 7 is evacuated.

Figure 3:
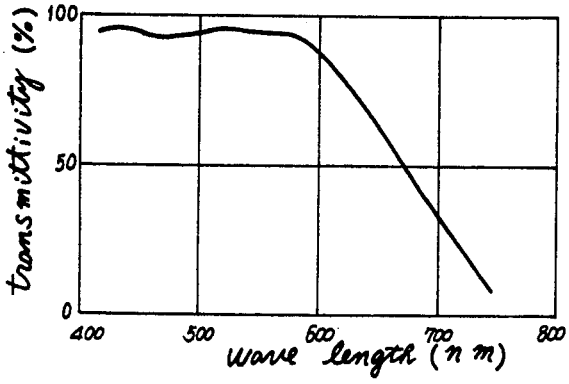
FIG. 3 is a graph showing the spectral characteristic of light transmittance of a light suppressing means used in the lamp of FIG. 2 embodying the present invention.
Figure 4:
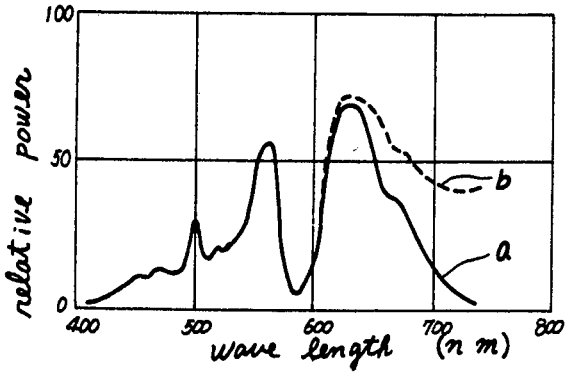
FIG. 4 is a graph showing spectral power distribution of light of the lamp of FIG. 2.

The outer bulb 7 is made of an infra-red or heat ray absorbing glass as a radiation suppressing means, for example a glass containing phosphorus pentoxide($P_2O_5$) as a principal part and a small amount of ferrous oxide (FeO). The spectral characteristic of the above-mentioned glass of the outer bulb 7 is, as shown in FIG. 3, to absorb spectral components exceeding the wave length of about 600 nm. Accordingly, in an actual example of the discharge tube 1 which is designed to operate at a tube input power of 400 watts, the spectral power distribution of the radiant power is satisfactorily improved as shown by the curve "*a*" of FIG. 4 in contrast to that of dotted curve "*b*" for a similar lamp with a conventional non-colored outer bulb of molybdenum glass (ordinary hard glass). As shown in FIG. 4, in the spectral power distribution of the light of the lamp of the present invention, part of the radiant corresponding to a wave length of over 620 nm is is absorbed by the bluish colored heat-ray absorbing glass, and accordingly, the resultant color temperature of the lamp becomes 3030°K and general color rendering index becomes about 86. The abovementioned color temperature of 3030° K is an improvement over that of 2500° K of the conventional type. As a modified example, a layer or film of the abovementioned heat ray glass or powder of bluish inorganic pigment, e.g., cerulean blue, prussian blue and cobalt blue can be coated on substantial part of the inner surface of the conventional non-colored outer bulb of ordinary hard glass.

Figure 5:
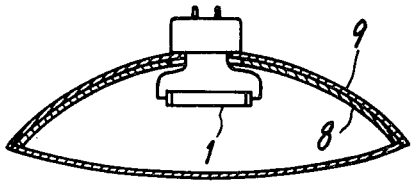
FIG. 5 is a side view of another high pressure sodium vapor discharge lamp wherein the discharge tube of FIG. 1 is contained.
Figure 6:
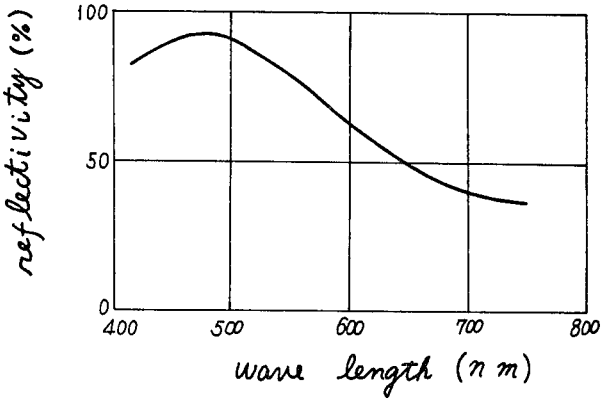
FIG. 6 is a graph showing the spectral characteristic of light reflectivity of another light suppressing means used in another lamp of FIG. 5 embodying the present invention.
Figure 7:
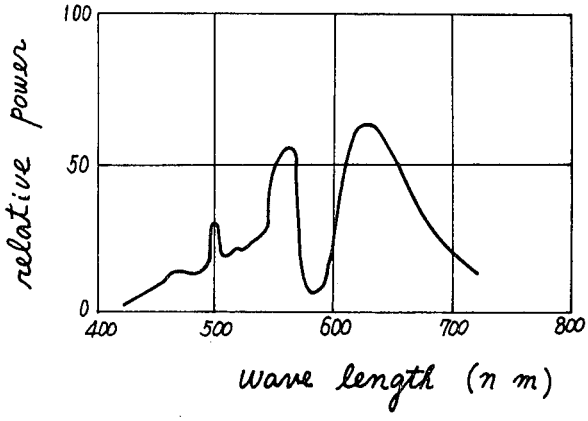
FIG. 7 is a graph showing spectral power distribution of light of the lamp of FIG. 5.

In another example shown in FIG. 5, the discharge tube described above referring to FIG. 1 is disposed and sealed in a reflector lamp type outer bulb 9 having a reflection film 8 formed on the inside face of the rear wall. The reflection film 8 is a film having the characteristic of reflecting light of a wave length of over 620 nm. Namely, the reflection film 8 as the light suppressing means does reflect blue and green while partly absorbing red radiation. For such reflection film 8, a multi-layered vapor deposited film comprises layers of magnesium fluoride ($MgF_2$) and zinc sulfide (ZnS). FIG. 6 shows spectral characteristic of the light reflectivity of the multi-layered $MgF_2$-ZnS reflection film 8. As shown in FIG. 6, the reflectivity is below 60% for the light of wave length of over 620 nm. FIG. 7 shows spectral power distribution of the radiation of the lamp of FIG. 5. By absorbing red radiation of wave length greater than 620 nm by the reflection film 8, the color temperature is improved. The characteristic of the finished lamp is that the tube input power is 150 watts, the color temperature is 2980° K and general color rendering index is 85.

Figure 9:
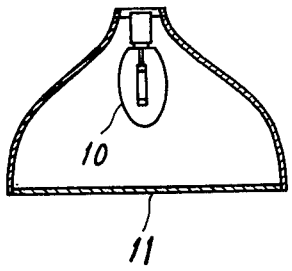
FIG. 9 is a partial sectional side view of still another high pressure sodium vapor discharge lamp of the present invention.

FIG. 9 shows another embodiment wherein a high pressure sodium vapor discharge lamp 10 with outer bulb of ordinary non-colored ordinary hard glass is disposed in a reflector hood, which comprises a front panel of a heat-ray absorbing glass as a light absorbing means. The heat-ray absorbing glass is, for example, a glass containing phosphorus pentoxide ($P_2O_5$) as a principal part and a small amount of ferrous oxide (FeO) and suppresses the transmission of light of a wave length greater than 620 nm.

Table 1 is a comparison table for the characteristics of examples of the high pressure sodium vapor discharge lamps of the present invention which lamps are made to have color temperatures of about 3000° K by using a discharge tube having a color temperature of about 2500° K, compared with examples of conventional high pressure sodium vapor discharge lamps which are made to have similar color temperature (i.e., about 3000° K) by substantially increase the sodium vapor pressure.

Table 1

| | Present Invention | | | | Prior Art | |
|---|---|---|---|---|---|---|
| Example of | FIG. 2 | FIG. 2 | FIG. 5 | FIG. 9 | | |
| type of | 150 watts | 400 watts | 150 watts | 150 watts | 150 watts | 400 watts |
| inner diameter "d" | 7.6 mm | 11.5 mm | 7.6 mm | 7.6 mm | 7.6 mm | 11.5 mm |
| inter-electrode gap "L" | 35 mm | 52 mm | 35 mm | 35 mm | 35 mm | 52 mm |
| substance contained in the tube* | Na 8.6mg Hg 32mg Xe 20 Torr | same - to - the - left | | | | |
| light suppressing means | outer bulb of heat absorbing glass | same to the left | reflection film of red light absorbing nature on the rear part of the outer bulb | front panel of heat absorbing glass for lamp hood | nil — bulb is of ordinary hard glass (molybdenum glass) | same to the left |
| input power | 150 w. | 400 w. | 150 w. | 15 w. | 150 w. | 400 w. |
| lamp voltage | 103 v. | 118 v. | 100 v. | 103 v. | 142 v. | 172 v. |
| color temperature | 3010° K | 3030° K | 3010° K | 3010° K | 2990° K | 3000° K |
| general color rendering index | 87 | 86 | 85 | 87 | 72 | 71 |
| efficiency | 53 lm/w | 71 lm/w | | | 38 lm/w | 50 lm/w |

*When (Ne + 0.5% Ar)-gas of 20 Torr is sealed instead of Xe, the efficiency decreases by several percent from the above table, but other values remain substantially unchanged.

As can be understood from the table 1, the lamps embodying the present invention show good color rendition and efficiency for a color temperature of about 3000° K, while the lamps of the prior art require fairly high lamp voltage, have considerably low efficiency and poor color rendition when made to achieve such a high color temperature of about 3000° K.

Figure 8:
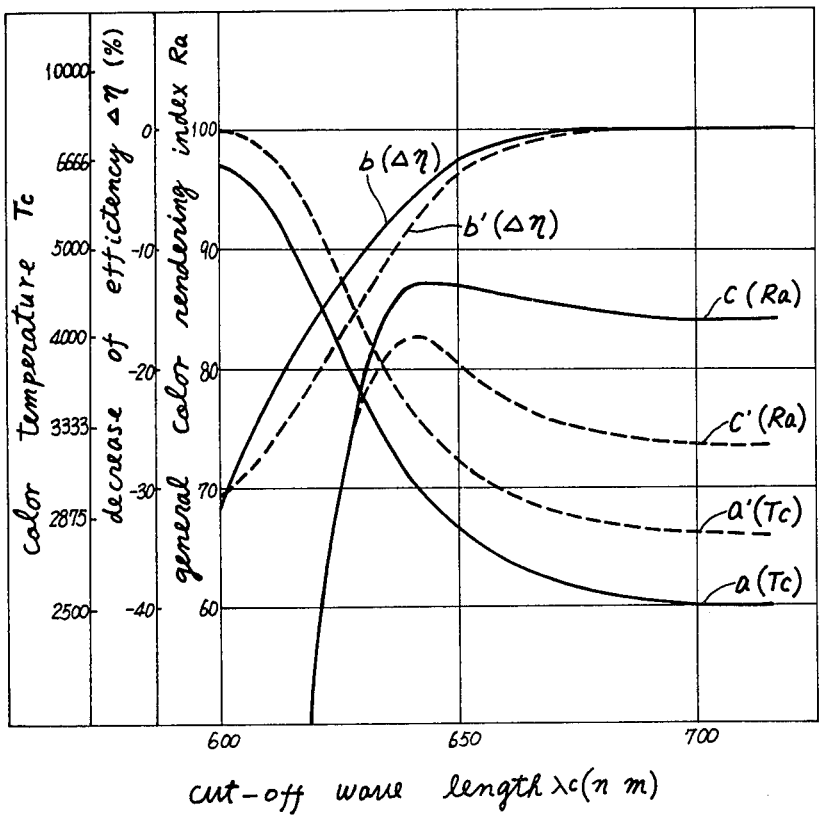
FIG. 8 is a graph showing relations of color temperature $Tc$ (in absolute temperature K), decrease of efficiency $\Delta\eta$ (in %) and general color rendering index Ra of the lamp embodying the present invention against the cut-off wave length $\lambda c$ (in nm) of the light suppressing means.

FIG. 8 shows curves of computor simulation for the lamps of the structure of FIG. 2 wherein details of the discharge tubes are as follows:

inner diameter *d:* 11.5 mm
inter-electrode gap L: 52 mm
substance contained in the tube
Na: 8.6 mg
Hg: 32 mg
Xe: 20 Torr
input power: 400 & 450 w. for
color temperatures: 2500° K & 2800° K, respectively.

The simulation was carried out by imposing the condition that the radiant power from the discharge tubes of the abovementioned examples is absorbed by an ideal high pass color filter which transmits radiation of wave lengths under the cut-off wave length λ *c* and absorbs radiation of wave lengths on and over λ *c*. In FIG. 8, solid lines *a*, *b* and *c* indicate color temperature, decrease of efficiency (due to the color filter) and general color rendering index for a discharge tube of a color temperature of 2500° K; dotted lines *a'*, *b'* and *c'* indicate those for the discharge tube of the color temperature of 2800° K.

According to the curves of FIG. 8, the color temperature curves *a* and *a'* have maximum gradients in the range of the cut-off wave length λ *c* of 620–650 nm. Therefore, by selecting the cut-off wave length in the range of 620 to 650 nm, the color temperature of the lamp can be selected within a wide range of 3000° K to 6000° K for the discharge tube having its color temperature of 2800° K, or in the range of 2800° K to 5000° K for the discharge tube having its color temperature of 2500° K. Furthermore, for such range of the cut-off wave length, the decrease in the efficiencies of the lamps is at most only 20%, and a high value of general color rendition index Ra of 60 to 90 is obtainable. For the cut-off wave length λ *c* shorter than 620 nm, the general color rendering index R*a* rapidly falls, resulting in poor color rendition. For the cut-off wave length of over 650 nm, the color temperature T*c* is not raised.

The curves *c* and *c'* for the general color rendering index have peaks in the range of the cut-off wave length of 620–650 nm. Namely, as the cut-off wave length becomes shorter from 630 nm towards 700 nm, the general color rendering index R*a* becomes large. The phenomenon is peculier to the high pressure sodium vapor discharge lamp, wherein the radiant power of the discharge tube increases across the entire visual range, as the sodium vapor pressure increases. Especially, when the sodium vapor pressure is so high that the color temperature is 2300° K–2400° K or more (such condition is realized by raising the temperature of the coolest point of the tube), red radiant power becomes dominant. Accordingly the flattering effect for the red color region becomes excessive, thereby lowering the general color rendering index R*a*. Therefore, as elucidated above, cutting-off of the excessive red radiant light results in improving the general color rendering index R*a*. The abovementioned phenomenon peculiar to the high pressure sodium vapor discharge tube can be observed only when the sodium vapor pressure is above a specified level. The phenomenon results when the following condition is satisfied:

$$E \geqq 37.7 - 2.05d,$$

wherein E(*v*/cm) is an average voltage gradient and *d*(mm) is the inner diameter of the discharge tube.

When the average voltage gradient is lower and can not satisfy the abovementioned condition, even if the radiant power of the long wave length range is cut off, the general color rendering index R*a* of FIG. 8 can not be raised, and only the color temperature is raised.

Though the abovementioned computor simulation is based on the condition of using an ideal light absorbing means, i.e., an ideal high pass color filter, the simulation has been verified experimentally.

As elucidated above, increasing the color temperature of the discharge tube per se of the high pressure sodium discharge lamp results in sacrificing the life of the lamp. Particularly, when the color temperature of the discharge tube is over 2800° K, the life becomes very short. Accordingly, the operating condition of the discharge tube should be selected in a manner to maintain the color temperature of the discharge tube to be lower than 2800° K. In order to ensure more stable long life operation, it is preferable to select the color temperature of the discharge lamp to be lower than 2700° K.

According to the present invention, a resultant color temperature of the lamp of about 3000° K or higher can be achieved by using a discharging tube which has a color temperature of around 2500° K or the like, as well as high efficiency and high color rendition.

Since high color rendition and high color temperature is obtainable, the lamp of the present invention is suitable for use in indoor illumination.

What we claim is:

1. A high pressure sodium vapor discharge lamp comprising an alumina tube envelope containing therein sodium, inert starting gas, a buffer gas source being at least one member selected from the group consisting of mercury and cadmium and discharge electrodes sealed in the envelope, in which an inner diameter d in nm of said tube envelope and an average potential gradient E in v/cm have the relation $$E \geqq 37.7 - 2.05d,$$

and said lamp further comprising a radiation suppressing means for selectively absorbing radiation of wave length longer than 620 nm, said radiation suppressing means being formed at least partly to surround said tube envelope.

2. A high pressure sodium vapor discharge lamp of claim 1 wherein said radiation suppressing means is a radiation passing substance which passes radiation of the wave length of 620 nm or shorter and suppresses light of the wave length longer than 620 nm.

3. A high pressure sodium vapor discharge lamp of claim 2 wherein said radiation suppressing means has a cut-off wave length in the range of 620 - 650 nm.

4. A high pressure sodium vapor discharge lamp of claim 2 wherein said radiation suppressing means is a heat-ray absorbing glass containing phosphorus pentoxide as principal component and a small amount of ferous oxide as additive.

5. A high pressure sodium vapor discharge lamp of claim 4 wherein said heat-ray absorbing glass forms an outer bulb enclosing said discharge tube.

6. A high pressure sodium vapor discharge lamp of claim 1 wherein said radiation suppressing means is a radiation reflection film which reflect radiation of the wave length of 620 nm or shorter and suppresses reflection of radiation of the wave length longer than 620 nm.

7. A high pressure sodium vapor discharge lamp of claim 6 wherein said radiation suppressing means is a multi-layered film comprising layers of magnesium fluoride and zinc sulfide.

8. A high pressure sodium vapor discharge lamp of claim 7, which further includes an outer bulb enclosing said tube envelope wherein said multi-layer film is a coating on at least a portion of the inner surface of said outer bulb, wherein said portion of said inner surface immediately surrounds said tube envelope.

9. A high pressure sodium vapor discharge lamp comprising an alumina tube envelope containing therein sodium, inert starting gas, buffer gas source comprising at least one of mercury and cadmium and discharge electrodes sealed in the envelope, inner diameter *d* in mm of said tube envelope and an average potential gradient E in v/cm having the relation $$E \geqq 37.7 - 2.05d,$$

characterized in that a radiant suppressing means which selectively absorbs radiation of the wave length longer than 620 nm is formed on an outer bulb enclosing said discharging tube.

10. A high pressure sodium vapor discharge lamp of claim 2, which further includes an outer bulb enclosing said discharge tube, wherein said radiation passing substance is a coating of bluish inorganic powder which is disposed on the inner surface of said outer bulb.

11. A high pressure sodium vapor discharge lamp of claim 6, which further includes an outer bulb enclosing said discharge tube, wherein said radiation reflecting film is a coating of bluish inorganic powder applied on at least a portion of the inner surface of said outer bulb wherein said portion of said inner surface immediately surrounds said tube envelope.

* * * * *